US005383740A

United States Patent [19]

Lancelot, III

[11] Patent Number: 5,383,740

[45] Date of Patent: Jan. 24, 1995

[54] COMBINATION MECHANICAL/GROUT SLEEVE COUPLING FOR CONCRETE REINFORCEMENT BARS

[75] Inventor: Harry B. Lancelot, III, Hurst, Tex.

[73] Assignee: Richmond Screw Anchor Company, Fort Worth, Tex.

[21] Appl. No.: 100,977

[22] Filed: Aug. 2, 1993

[51] Int. Cl.[6] ..... B25G 3/34; F16B 11/00

[52] U.S. Cl. ..... 403/267; 403/268; 403/299; 52/726.1

[58] Field of Search ..... 403/265, 266, 267, 268, 403/299, 300, 307; 52/726.1, 726.3

[56] References Cited

U.S. PATENT DOCUMENTS

| | | | |
|---|---|---|---|
| 3,540,763 | 11/1970 | Yee | 403/265 |
| 3,552,787 | 1/1971 | Yee | 403/265 |
| 3,638,978 | 2/1972 | Guntermann | 403/267 |
| 3,694,012 | 9/1972 | Gelfand | 52/726.1 |
| 3,701,555 | 10/1972 | Harris | 52/726.1 |
| 3,756,635 | 9/1973 | Beers | 403/267 |
| 4,095,389 | 6/1978 | Outram et al. | 403/268 |
| 4,627,212 | 12/1986 | Yee | 52/726.1 |
| 4,692,052 | 9/1987 | Yee | 403/265 |
| 4,752,151 | 6/1988 | Ashida et al. | 403/266 |
| 5,046,878 | 9/1991 | Young | 403/265 |
| 5,152,118 | 10/1992 | Lancelot | 52/726.1 |
| 5,230,199 | 7/1993 | Yee | 52/726.1 |

FOREIGN PATENT DOCUMENTS 2034857 6/1980 United Kingdom ..... 52/726.1

OTHER PUBLICATIONS

Commercial brochure by Erico, Inc. "Interlok Splicing Systems" 1992.

*Primary Examiner*—Richard E. Gluck
*Assistant Examiner*—Howard R. Richman
*Attorney, Agent, or Firm*—Natan Epstein

[57] ABSTRACT

Disclosed is a combination hybrid splice sleeve which has a threaded end for making a mechanical joint with a male thread on a rebar end, and an opposite end open for receiving a second rebar, which need not be threaded, for making a grout joint between the sleeve and the second rebar. This sleeve has a tapering cross section between a wide end and a narrow end, with internal radial ridges of constant height spaced between the two opposite ends. A threaded cylindrical bore is axially aligned in the wide end for screwing to a first rebar. The narrow end is open for receiving a second rebar. Two grout ports open radially into the sleeve. The first grout port is near to the narrow end, and the second grout port is proximal to the threaded bore. The second grout port is of smaller aperture than the first grout port, for partially restricting out flow of grout injected through the first grout port, to encourage filling of the sleeve by building up some back pressure.

9 Claims, 1 Drawing Sheet

COMBINATION MECHANICAL/GROUT SLEEVE COUPLING FOR CONCRETE REINFORCEMENT BARS

BACKGROUND OF THE INVENTION

1. Field of the Invention

This invention pertains to the field of reinforcements embedded in poured concrete structures and more specifically concerns a coupling for end-to-end splicing of steel reinforcement bars.

2. State of the Prior Art

Steel reinforcement bars, commonly known as rebars, have been in widespread use in the concrete construction industry and numerous devices have been developed for splicing such rebars end-to-end where longer lengths are required, or for tying together precast concrete structures.

The known devices include threaded joints achieved by an internally threaded coupling sleeve, and grout joints where a mortar filled sleeve holds together the ends of two rebars. Grout splice sleeves are exemplified by U.S. Pat. Nos. 3,552,787; 4,692,052; 3,540,763 and 4,627,212, all issued to Yee. The U.S. Pat. No. 3,540,763 to Yee discloses a sleeve which tapers from a maximum diameter at a central point to terminate in opposite open ends. Two holes in the sleeve near the ends allow injection of a hardening grout which sets around the ends of two rebars inserted into the opposite ends of the sleeve. The interior surface of the sleeve is circumferentially grooved to better grip the grout material, and the opposing tapers of the sleeve provide a wedge-type lock on the bars to make an end to end splice. The U.S. Pat. No. 4,627,212 to Yee discloses variations on the earlier splice sleeve, including a sleeve with a straight cylindrical portion joined to a portion of tapering diameter, both portions having internal ridges spaced along the sleeve, the ridges in the cylindrical portion being of increasing height towards the end of the sleeve, while the ridges in the tapering portion are of constant height. This sleeve has two grout ports through which grout is injected into the sleeve. An inlet port is on the cylindrical portion, while an outlet port is near the end of the tapering portion. The outlet port is of smaller cross section than the inlet port, somewhat restricting outflow of the grout to ensure filling of the sleeve.

It is also well known to make a rebar splice by threading the rebar ends and joining the threaded ends by means of an internally threaded coupling sleeve. In particular, U.S. Pat. No. 5,152,188, commonly owned with this application, discloses a three piece mechanical splice in which the threaded rebar ends have been upsized to a diameter greater than the nominal diameter of the rebar rod.

While both threaded couplings and grout sleeves have been developed, a need exists for a coupling device which combines the advantages of each splicing method. A threaded coupling is quick and easy to make, and with proper attention to fabrication of the coupling sleeve and the rebar threading, such joints can be strong and dependable. Grout splices, while more complicated in that they require injection of properly mixed mortar, are useful where the rebar cannot be rotated relative to the splice sleeve, as would be necessary for a threaded joint. Such a condition commonly occurs where two precast concrete elements are to be joined. Reinforcing bars embedded in such precast structures cannot be rotated in order to make a splice or joint. The problem can be solved by providing grout sleeves on one of the elements, so that the sleeves are secured and aligned to receive protruding rebar ends on the other precast element, and the joints are then fixed together by injecting into the sleeves a cementitious compound, such as mortar and grout compounds which are commercially available for this purpose, and which upon hardening prevents separation of the sleeves and rebar ends.

SUMMARY OF THE INVENTION

In response to the aforementioned need, the present invention provides a combination hybrid splice sleeve which has a threaded end for making a mechanical joint with a male thread on a rebar end, and an opposite end open for receiving a second rebar, which need not be threaded, for making a grout joint between the sleeve and the second rebar.

More particularly, the hybrid coupler sleeve according to this invention is a sleeve of tapering cross section between a wide end and a narrow end, with internal radial ridges of constant height spaced between the two opposite ends. A threaded cylindrical bore is axially aligned in the wide end for screwing to a first rebar. The narrow end is open for receiving a second rebar. Two grout ports open radially into the sleeve. A first grout port is near to the narrow end, and a second grout port is proximal to the threaded bore. The second grout port is of smaller aperture than the first grout port, for partially restricting out flow of grout injected through the first grout port, to encourage filling of the sleeve by building up some back pressure.

A superior splice joint is obtained by threading the sleeve of this invention to a first rebar characterized in that the minimum diameter of the threaded rebar end is greater than the nominal diameter of the rebar rod. A second rebar inserted into the open narrow end of the sleeve is retained in the sleeve by a mortar or equivalent cementitious compound injected through one of the grout ports to fill the sleeve around the second rebar.

These and other improvements, features and advantages of the present invention will be better understood by reference to the following description of the preferred embodiment taken in conjunction with the accompanying drawings.

DETAILED DESCRIPTION OF THE PREFERRED EMBODIMENT

Figure 1:
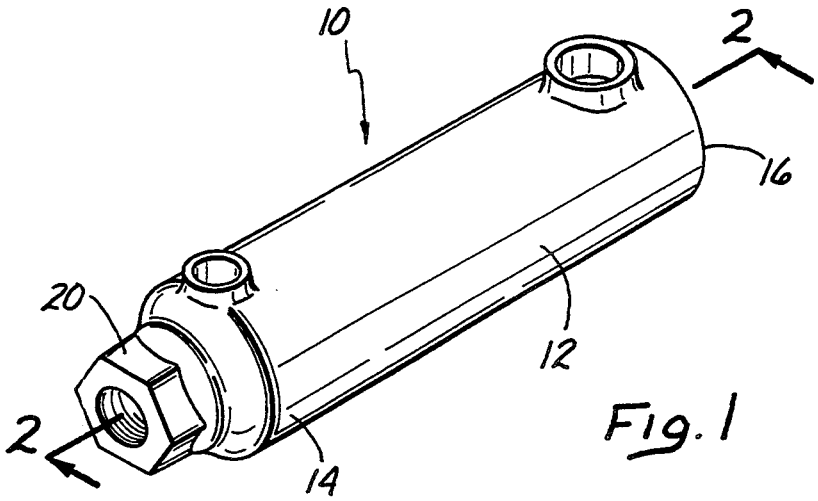
FIG. 1 is a perspective view of the combination splice sleeve of this invention.
Figure 2:
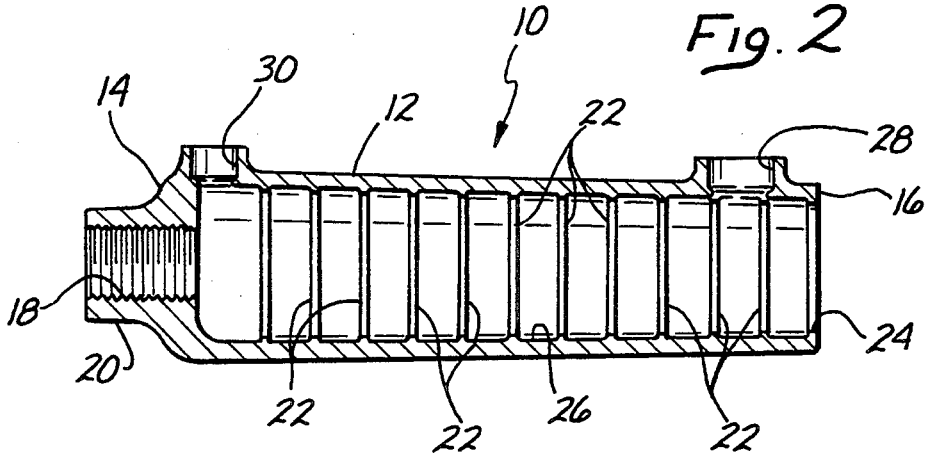
FIG. 2 is a longitudinal cross section taken along line 2—2 in FIG. 1.

With reference to the accompanying drawings, FIG. 1 shows the combination splice sleeve of this invention which is generally designated by the numeral 10 and has a tubular sleeve body 12 of circular cross section which tapers in diameter between a larger closed end 14 and a smaller open end 16. As seen in FIG. 2, the closed end 14 is formed in the shape of a hexagonal nut 20 integral with the sleeve body 12. A cylindrical bore 18 through the hexagonal nut 20 is internally threaded and is coaxial with the sleeve body 12 . The internal thread has a constant crest diameter along the bore 18. A series of internal ribs 22, including an end rib 24 at the open end 16, are evenly spaced in an axial direction within the sleeve body 12. The ribs 22 are integral with the sleeve body and are of equal radial height measured inwardly from the cylindrical inner surface 26 of the sleeve body. Two grout ports are provided on the sleeve body 12. A larger grout injection port 28 opens radially into the sleeve body 12 near the open end 16, and a smaller grout relief port 30 opens radially into the sleeve body 12 adjacent to the closed end 14.

Figure 3:
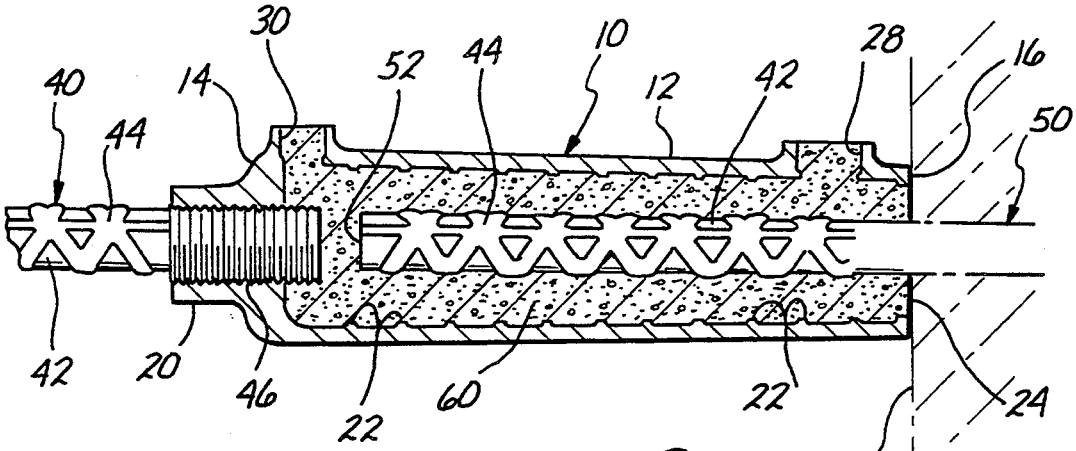
FIG. 3 is a section as in FIG. 2 showing the sleeve a splice joint between two reinforcing bars made with the splice sleeve of FIG. 1.

A combination threaded/grout splice joint using the splice sleeve 10 as shown in FIG. 3. A first concrete reinforcement bar 40 has a cylindrical bar body 42 with raised deformations 44 extending along the bar body. The rebar 40 has a threaded end portion 46 which is upsized in diameter by forging of the rebar prior to forming the thread, so that the minimum diameter of the threaded end 46, i.e., the diameter measured at the bottom of thread, is greater than the nominal diameter of the cylindrical rod body 42. The upsized threaded end 46 keeps the thread groove from cutting into and diminishing the nominal diameter of the rod 42 in the threaded end portion, and consequently avoids a reduction in the tensile strength of the bar 40 due to the threading. The mechanical or threaded portion of the splice joint in FIG. 3 is made by simply screwing the sleeve coupler 10 onto the threaded end 46 of the bar 40, and tightening the joint with a suitable wrench or similar tool engaged to the hex nut 20 while the bar 40 is held against rotation about its axis by a shoulder, running nut or thread stop. The completed splice joint shown in FIG. 3 is capable of developing the full tensile strength of the bar 40 because the threading 46 does not cut into the nominal bar diameter.

A second concrete reinforcing bar 50 is similar to the first bar 40, except that it does not require end threading and therefore has a conventional end 52 with raised deformations 44 extending along the rod body 42 of the rebar 50 up to the end 52 of the bar. An end portion of the bar 50 is inserted into the open end 16, while the interior of the sleeve body 12 may be prefilled with fluid grout, or fluid grout may be injected after the rebar 50 is positioned in the sleeve 10. The formulation of the grout is well known in the industry, and such compounds are commercially available with various tensile strength ratings for the hardened grout. A 10,000 pound grout strength is suitable for the combination splice joint with the sleeve 10. Fluid grout is injected under pressure into the larger diameter inlet port 28 by means of a pump, in a manner which is well understood in the trade. In a typical installation, both rebars 40 and 50 may be embedded in separate preformed concrete structures being joined. The open end 16 of the splice sleeve 10 is shown closed by an end surface S of the concrete structure which contains the second rebar 50, so that an end portion of the bar 50 extends from its concrete structure through surface S and into the sleeve 10 while the end surface S closes-off the sleeve end 16 and prevents fluid grout from escaping through the end of the sleeve. The fluid grout injected under pressure fills the interior of the sleeve body 12 and the excess grout flows out through the relief port 30. The port 30 is of smaller aperture than the inlet port 28 so as to partially restrict the fluid grout against escaping from the sleeve body 12 and thereby ensure that the sleeve becomes completely filled with grout around the rebar 50. In some installations, the splice sleeve 10 itself may be embedded in a concrete structure together with the rebar 40, with short lengths of tubing connected to the ports 28, 30 extending through the concrete to an outer surface of the structure, so as to provide conduits between the two grout ports and the exterior of the structure being assembled. These conduits (not shown in the drawings) will normally become completely filled with grout as well, to avoid any empty space which might weaken the assembled structure. In the alternative, the sleeve 10 may bridge a void between the two precast concrete structures, which void is subsequently filled with concrete, once the rebar splice is completed. FIG. 3 shows the sleeve body 12 completely filled with grout 60 which, once solidified, grips the raised deformations 44 on the second rebar 50 and prevents the bar 50 from being pulled out of the sleeve body 12. The solid grout 60 is wedged against withdrawal from the sleeve 12 by the tapering inner diameter of the sleeve body 12 between the closed end 14 and the open end 16. In addition, the solidified grout 60 is held axially by the internal circumferential ribs 22 and the end rib 24 of the splice sleeve 10.

Concrete reinforcing bars are made in industry-wide standard sizes, ranging from #4 to #18 bars, where the nominal diameter of the bar is specified for each bar number, although the pattern of the raised deformations 44 may vary from one manufacturer to another. In the splice sleeve 10 of this invention, the internal thread 18 is sized such that the diameter of the internal thread 18, as measured at the bottom of the thread 18, corresponding to the diameter of the rebar threading 46 measured at the thread crest is greater than the industry standard nominal diameter of the bar number for which the sleeve is intended, so that the internal thread 18 accepts only upsized threading for each standard bar size. The following Table 1 lists nominal diameters for each rebar number and a suitable upsized thread diameter for the threaded end 46, which is also the diameter for the corresponding inner thread 18 of the splice sleeve 10. The thread diameter is given in inches measured at the thread bottom, followed by the industry-recognized thread number. The thread diameters given in Table 1 is a minimum diameter for each corresponding bar size, and the thread diameter for each bar size may be substantially larger than the corresponding minimum diameter.

TABLE 1

| BAR SIZE | NOMINAL BAR DIA (inches) | MINIMUM THREAD SIZE |
|---|---|---|
| #4 | 0.500 | ⅝" -11 |
| #5 | 0.625 | ¾" -10 |
| #6 | 0.750 | ⅞" -9 |
| #7 | 0.875 | 1" -8 |
| #8 | 1.000 | 1⅛" -8 |
| #9 | 1.128 | 1¼" -8 |
| #10 | 1.270 | 1 7/16" -8 |
| #11 | 1.410 | 1 9/16" -8 |
| #14 | 1.693 | 1⅞" -8 |

The splice sleeve 10 can be made in various sizes to accommodate different reinforcing bar diameters. A suitable taper of the sleeve body 12 may be a 1 degree taper. The radial height of the ribs 22 and their axial spacing within the sleeve body 12 may be similar for differently sized splice sleeves 10. Likewise, the aperture of the grout ports 28, 30 is preferably the same for the different sleeve sizes so as to accept standard tubing and grout hose nozzles used in the trade.

It is contemplated that in an alternate embodiment of the combination mechanical/grout coupling sleeve described above, the inlet grout port 28 may be omitted from the sleeve 10, in which case the fluid grout is poured into the sleeve through the open end 16, the relief port 30 functioning as previously described. In practical usage of the coupling sleeve 10, the threaded end 20 of the sleeve 10 will be screwed into a vertical rebar end so that the open end 16 is oriented upwardly and can readily accept the fluid grout.

While a presently preferred form of the invention has been described and illustrated for purposes of clarity and example only, it will be understood that many changes, substitutions and modifications to the described embodiments will become readily apparent to those possessed of ordinary skill in the art without thereby departing from the scope and spirit of the present invention which is defined by the following claims.

What is claimed is:

1. A coupler for reinforcement bars comprising:

a sleeve of tapering cross section between a wide end and an open narrow end, ridge means in said sleeve spaced between said ends, a threaded bore of constant diameter axially aligned in said wide end, a first grout port in said sleeve proximal to said threaded bore and a second grout port in said sleeve proximal to said narrow end.

2. The coupler of claim 1, wherein said ridge means comprise radial ridges.

3. The coupler of claim 2, wherein said radial ridges are of constant height.

4. The coupler of claim 1, wherein said second grout port is wider than said first grout port.

5. A coupler for reinforcement bars comprising:

a sleeve of tapering cross section between a wide end and an open narrow end, radial ridges of constant height in said sleeve spaced between said ends, a threaded bore of constant diameter axially aligned in said wide end, a first grout port in said sleeve proximal to said threaded bore and a second grout port in said sleeve proximal to said narrow end, said second grout port being wider than said first grout port.

6. A rebar joint comprising:

a sleeve of tapering cross section between a wide end and an open narrow end, ridge means in said sleeve spaced between said ends, a threaded bore of constant diameter axially aligned in said wide end, a first grout port in said sleeve proximal to said threaded bore and a second grout port in said sleeve proximal to said narrow end; and a first rebar having a threaded end characterized in that the minimum diameter of said threaded end is greater than a nominal diameter of said rebar, said threaded end being threaded into said bore of the sleeve;

whereby a second rebar inserted into said narrow end may be retained in said sleeve and joined to said first rebar by cementitious compound injected into said sleeve.

7. The rebar joint of claim 6, wherein said ridge means comprise radial ridges.

8. The rebar joint of claim 7, wherein said radial ridges are of constant height.

9. The rebar joint of claim 6, wherein said second grout port is wider than said first grout port.

* * * * *